United States Patent [19]

Inman

[11] 3,944,688

[45] Mar. 16, 1976

[54] METHOD FOR THE MANUFACTURE OF WATER-REPELLENT, FIRE-RESISTANT NONWOVEN FABRICS

[75] Inventor: Charles Edward Inman, Glenside, Pa.

[73] Assignee: Pennwalt Corporation, Philadelphia, Pa.

[22] Filed: Oct. 23, 1973

[21] Appl. No.: 408,687

[52] U.S. Cl. ..... 427/381; 427/390; 427/412; 428/921

[51] Int. Cl.[2] ..... B44D 1/46; C09K 3/28

[58] Field of Search..... 117/140 A, 136, 121, 76 T, 117/76 FB; 427/381, 390, 412; 428/921

[56] References Cited

UNITED STATES PATENTS

| | | | |
|---|---|---|---|
| 2,142,115 | 1/1939 | Cupery | 117/137 |
| 2,178,625 | 11/1939 | Clayton et al. | 117/137 |
| 2,357,725 | 9/1944 | Bennett | 117/137 X |
| 2,978,785 | 4/1961 | Wenzell et al. | 117/140 A |
| 3,081,197 | 3/1963 | Adelman | 117/140 A |
| 3,256,228 | 6/1966 | Tyran | 117/140 A |
| 3,380,851 | 4/1968 | Lindemann et al. | 117/140 A |
| 3,529,995 | 9/1970 | Smith et al. | 117/76 T |
| 3,655,422 | 4/1972 | Goldbeck et al. | 117/62 X |

*Primary Examiner*—Michael R. Lusignan

[57] ABSTRACT

A fire-resistant, water- and oil-repellent nonwoven fabric is prepared using a fire-retardant, surfactant-free adhesive/binder containing halogen and/or phosphorus additive, followed by treatment with a fluorochemical repellent agent.

6 Claims, No Drawings

METHOD FOR THE MANUFACTURE OF WATER-REPELLENT, FIRE-RESISTANT NONWOVEN FABRICS

This invention relates to an improved method of producing a fire-resistant, water-and oil-repellent nonwoven fabric. More particularly, this invention concerns a two-step process in which a nonwoven substrate is first prepared from conventional fibers using a fire-resistant, surfactant-free adhesive/binder, followed by treatment of the nonwoven substrate with a limited amount of fluorochemical oil-and water-repellent agent.

Nonwoven fabrics are broadly defined as a textile structure consisting of a web or mat of fibers held together with a binding material (adhesive). Natural or synthetic fibers and blends thereof may be used, including cotton, rayon, cellulose acetate and triacetate, nylon, acrylic, polyester, paper, wood pulp fibers and the like. Conventional techniques for preparing nonwoven fabrics are well known and described in the literature, for example, "Chemicals for Nonwoven Fabrics," J. Taylor, American Dyestuff Reporter, Mar. 9, 1959, and "The New Trend in Fiber Processing Technology," A. J. Bobkowicz, Soil and Crop Science Society of Florida, v. 21, pages 148–170 (1961); R. Krěma, "Nonwoven Textiles," Textile Trade Press, Manchester, England (1962); M. McDonald, "Nonwoven Fabrics Technology," Noyes Data Corp., Park Ridge, N.J. (1971); and U.S. Pat. Nos. 3,126,297; 3,316,122; 3,658,579 and 3,310,459.

A major use of nonwoven fabrics now being produced commercially is as disposable surgical caps, gowns, pads, drapes and the like for hospital use. Such articles are normally made repellent not only to protect the wearer, but also to prevent the transfer of liquid borne infections from doctor-to-patient and patient-to-doctor. Fluorochemical repellents, even though more costly than the conventional hydrocarbon repellents, are preferred for this use because of greater durability to sterilization treatments and greater resistance to penetration by alcoholic and low-surface tension disinfectant solutions. It is generally expected throughout the industry that in the near future the U.S. Federal Trade Commission will impose flammability limits on all nonwoven fabrics sold for hospital use. It has been a major objective, therefore, for producers of such goods to develop an effective, yet economical, fire-resistant and repellent treatment for nonwoven fabrics.

Intent on minimizing costs, most workers in the field have concentrated their efforts on formulating a one-bath, combined adhesive or binder/fire-retardant/-fluorochemical repellent treatment. This approach, however, has a number of major difficulties and disadvantages, including the following: The less expensive fire retardants are water-soluble salts such as ammonium sulfate, ammonium sulfamate, ammonium bromide, mono-and diammonium phosphate, and the like. These salts are required in relatively high loadings (10 to 20% on weight of dry fabric) in order to reduce flammability. When the resulting large amounts of such ionic salts are combined with repellents, especially latex or emulsion-type repellents, high concentrations of surfactants are often required to overcome bath instability. After application to the fabric, the high level of both surfactant and soluble fire-retardant salt tend to override repellency by a combined rewetting/wicking action. Use of two-bath treatments, that is, application of the binder/adhesive followed by a fire-retardant/repellent combination or application of the repellent combined with the binder/adhesive followed by the fire-retardant, in general has also failed to overcome these difficulties. These effects can only be overcome by the use of a larger amount of the fluorochemical repellent, making the treatment too costly for practical usage. Attempts have also been made to utilize in the one or two-bath treatment the so called "durable" textile fire retardants, which, due to chemical reactivity, produce a water insoluble treatment. On the whole, such finishes are too costly for products that are intended to be disposed of after one use, and most of these finishes also require multiple processing steps for application which is undesirable for low-cost products such as the nonwovens. Yet another process, described in a recent patent, U.S. Pat. No. 3,655,422, attempts to circumvent the difficulties by applying the binder, the fluorochemical repellent, and the fire retardant, each from separate baths. However, not only is a special heat-degradable surfactant required in the fire-retardant bath, but the multiplicity of processing steps greatly adds to the cost of the finished fabric.

A new method of producing a fire retardant/repellent nonwoven fabric has now been discovered, which not only can be carried out by conventional processing techniques, but which also eliminates the heretofore prohibitively large requirement for expensive fluorochemical repellent. In the practice of this invention, the nonwoven sheet is assembled using conventional equipment; but using fire-retardant, "surfactant-free" scrim adhesives in the case of a scrim-reinforced (SRM) fabric, or in the case of a wet-or dry-laid fabric, using fire-retardant, "surfactant-free" saturation binders. Then, in a second bath, the assembled nonwoven fabric is treated with a repellent of the fluorochemical type. The less expensive fire retardant additives, such as those mentioned previously, may also be added in minimal amounts to repellent formulations in order to bring the treated fabrics to a desired level of non-flammability. The same ingredients applied together in a single-bath process do not provide required economies or satisfactory performance.

Briefly stated, the process of this invention involves a two-bath method of preparing an oil- and water-repellent, fire-retardant, nonwoven fabric, embodying the steps of:

A. fabricating a nonwoven fabric of fibers bound together by about 5 to 50%, preferably about 20 to 30%, (based on dry weight of non-woven fabric) of fire retardant, surfactant-free adhesive/binder solids selected from the class consisting of alkyl acrylate and vinyl acetate aqueous dispersion polymers, containing in admixture therewith from about 25% to 110% preferably about 50 to 100% (based on the weight of said polymer) of halogen-and/or phosphorus-containing flame retardant agent; and drying the fabric, usually at a temperature of from about 195° to about 300°F;

B. contacting the fabric with an aqueous bath containing in admixture a fluorochemical oil- and water-repellent substance, said fluorochemical repellent being present in sufficient amount to deposit from about 0.05 to 0.8% by weight of repellent solids based on the dry fabric. Optionally, there may be in admixture within the aqueous fluorochemical-containing bath, and depending on the degree of fire-retardancy imparted to the fabric by the binder used in step (A), a water-soluble, fire-retardant salt, said salt being present in sufficient quantity to impart additional fire-retardancy to said fabric but being no greater than about 6% by weight of the dry fabric; and finally drying the fabric.

The adhesive/binder systems used in the first step of the process of this invention are aqueous polymer dispersions of vinyl acetate or of alkyl acrylates (e.g., lower alkyl esters of acrylic or methacrylic acid wherein the alkyl group has one to six carbon atoms) said polymer dispersions having been synthesized using dispersion stabilizers, i.e., protective colloids, in minimal amounts in lieu of emulsifiers. Methods for preparing such so-called "surfactant-free" polymer dispersions are well known; see, for instance, Kirk-Othmer, Encyclopedia of Chemical Technology, Second Edition, Vol. 21 p. 331 and Vol. 1, p. 305, John Wiley & Sons, N. Y.; Encyclopedia of Polymer Science and Technology, Vol. 1, pg. 204, and Vol. 15, pg. 607, John Wiley & Sons, N.Y.; Technical Bulletin, "Vinyl Acetate," Celanese Chemical Co.; and Canadian Pat. No. 676,155. Protective colloids operable herein may be generally classified under two types: (1) natural or modified-natural products, such as gum agar, gum arabic, gum tragacanth, water soluble starches, pectin, gelatin, alginates, and modified cellulosics such as carboxymethyl cellulose and hydroxycellulose; and (2) synthetic products such as polyvinyl alcohol, polymethacrylamide, polyvinylpyrollidone, sufonated polystyrene, and alkali salts of polymethacrylic and polyacrylic acids. The preferred stabilizers for the polymeric dispersions used in this invention are hydroxyethyl cellulose and polyvinyl alcohol. The acrylate polymer or vinyl acetate polymer may be made hydrophilic, thus being more easily stabilized in aqueous dispersions, by incorporating functional groupings such as hydroxyl, amines, amides, sulfonates, and carboxylates, into the basic polymer backbone by copolymerization of the vinyl acetate or alkyl acrylate with an appropriate functional monomer.

The halogen and/or phosphorus-containing flame retardant agent that is combined with the aforesaid binder/adhesive may be selected from a wide variety of known compositions, many commercially available, see Modern Plastics Encyclopedia, Vol. 47, No. 10A(19-70–71), p. 854, McGraw-Hill, N. Y.; and Encyclopedia of Polymer Science and Technology, Vol. 7, p. 21, John Wiley & Sons, N. Y. Preferred for utilization with the present polyacrylate and polyvinyl acetate systems are tricresyl phosphate, diphenyl cresyl phosphate, tributyl phosphate, trioctyl phosphate, tris(2-ethylhexyl) phosphate, tris(chloroethyl) phosphate, tris(dichloropropyl) phosphate, tris(dibromopropyl) phosphate, and chlorinated paraffins. When the above-described adhesive/binder and firs retardant agent/plasticizer systems are employed in the construction of the nonwoven in the amounts previously specified, sufficient flame resistance is imparted to the fabric so that the requirement for additional water-soluble, fire retardant salts is generally less than 6% of the weight of the dry fabric. The adhesive/binders may make up 5–50% of the final weight of the nonwoven fabric, although generally 20–30% is preferred. The assembled nonwoven structure is dried in a conventional manner by heating to about 195°–300°F, such as by passage through steam-heated rolls.

The fluorochemical repellent agents which are utilized in the second step treatment for the assembled nonwoven fabric according to the process of this invention are well known compositions. Preferred repellent agents are aqueous latices of acrylate and methacrylate polymers and copolymers having long chain (e.g., $C_6$–$C_{16}$) fluorinated alkyl side-chains or "tails" which impart the hydrophobic and oleophobic characteristics to the substrate. Representative and typical of such preferred fluorochemical agents are the following: U.S. Pat. No. 3,068,187 describing copolymers based on the monomer $R_fSO_2N(CH_2CH_3)CH_2CH_2OOC(CH_3)C{=}CH_2$ where $R_f$ is perfluoroalkyl of at least four carbon atoms; U.S. Pat. No. 3,378,609 describing a polymer or copolymer of $R_fCH_2CH_2OOC(CH_3)C{=}CH_2$; U.S. 3,544,633 describing polymers and copolymers of $R_fCH_2CH_2SOC(CH_3)C{=}CH_2$, and the acrylate homologs of the foregoing methacrylate fluoroalkyl monomers. Other representative fluorochemical agents operable in the invention are described in U.S. Pat. Nos. 3,102,103; 3,248,260; 3,256,230; 3,256,231; 3,277,039; 3,282,905; 2,803,615; 3,385,812; 3,384,627; 3,386,977; 3,395,174; 3,428,709; 3,457,247; 3,497,575; 3,356,628; 3,532,659; and 3,547,861. Yet other representative fluorochemical agents are chromium coordination complexes of a perfluoroalkyl carboxylic acid, wherein the perfluoroalkyl group (linear or branched chain) embodied therein desirably contains from about 6 to about 18 carbon atoms, preferably 8 to 15 carbon atoms. Representative complexes are described in U.S. Pat. No. 3,351,643 which discloses chromium coordination complexes of perfluoroalkyl acids of the structure $$R_f\overset{\overset{\displaystyle OR}{\|}}{C}NR'{-}COOH$$

where $R_f$ is perfluoroalkyl, R is hydrogen or alkyl having one to four carbon atoms and R′ is alkylene having one to six carbon atoms; and U.S. Pat. No. 2,934,450 which describes chromium coordination complexes of perfluoroalkyl acids having the structure $$R_fSO_2\overset{\overset{\displaystyle R}{|}}{N}R''COOH$$

where $R_f$ is the perfluoroalkyl group, R is hydrogen or alkyl having 1 to 6 carbon atoms and R′ is an alkylene group having from 1 to 12 carbon atoms. Other perfluoroalkyl carboxylic acids of this type which may be converted into chromium coordination complexes essentially in the manner described in the foregoing patents and used in the second step of the process of this invention are represented by the following (where *n* and *m* are integers as described in the references):

$$R_f(CH_2)_nS\underset{\underset{\displaystyle CH_2COOH}{|}}{C}HCH_2COOH$$

and the other fluoroalkyl acids described in U.S. Pat. No. 3,471,518; $R_fCOOH$ as described in U.S. Pat. No. 3,311,566; $R_f(CH_2)_nCOOH$ as described in U.S. Pat. No. 2,951,051; $R_f(CH_2)S(CH_2)_nCOOH$ as described in U.S. Pat. No. 3,172,910; $R_fO(CF_2)_mCOOH$ and $R_fO(CF_2)_m(CH_2)_nCOOH$ as described in U.S. Pat. No. 3,453,333; $R_fO(CF(CF_3)CF_2O)_nCF(CF_3)COOH$ as described in U.S. Pat. No. 3,274,239 and U.S. Pat. No.

3,250,080; $R_f(CH_2)_nO(CH_2)_2COOH$ and other acids described in U.S. Pat. Nos. 3,231,604 and 3,145,222; and $R_fCH(OH)COOH$ described in U.S. Pat. No. 3,202,706, and other like fluoroalkyl acids. Optionally, there may be combined with the fluorochemical repellent a less costly non-fluorinated repellent which acts as an extender therefor. Typical of those materials useful as extenders are resins prepared by reacting methylolated melamine, urea, guanidine and like amines or amides with organic alcohols, acids, amides, amines, or ketones where in at least one alkyl, alkenyl, cycloalkyl or alkaryl grouping consists of a chain of eight carbon atoms or greater. Such products are normally supplied in a form of emulsions or solids capable of emulsification, and may on occasion be combined with emulsified waxes. Products of these types are described in U.S. Pat. Nos. 2,361,185; 2,471,346; 2,236,672; 2,783,231; 2,398,569; 2,197,357; 2,927,090; 2,477,346; 2,313,741; 3,232,697; 3,337,362; 2,793,142; 3,067,159; 2,693,460; 3,180,750; 3,480,579; and 3.067,159. Other useful extenders are of the stearamidomethyl pyridinium chloride type as described in U.S. Pat. Nos. 2,212,654 and 2,361,185.

Optionally in admixture with the above-described fluorochemical repellent in the second step treatment of the process is a water-soluble, inorganic, fire-retardant salt in an amount in the aqueous composition sufficient to provide up to about 6%, preferably 2 to 3%, of the salt retained on the fabric on a dry weight basis. Representative and preferred of such fire-retardant salts are ammonium sulfate, ammonium sulfamate, ammonium bromide, mono- and diammonium phosphates, borax, and boric acid salts. Other fire retardant salts are described in Textile World, "Update: Flame-Retardant Chemicals," Vol. 119, No. 10 (1969), p. 102. Following the second stage treatment for repellency as herein described, the nonwoven fabric is dried and cured at from about 220° to 300°F, using conventional nonwoven drying techniques.

The degree of fire retardancy residing in the nonwoven fabrics prepared in accordance with this invention may be regulated over a wide scope ranging from fabrics which do not ignite or support combustion to fabrics which have some flame resistance (i.e., reduced flammability) for safety to the user but can be disposed of by burning the solid material for reasons of sanitation. The degree of flame retardancy may be measured by the simple Match Test (National Fire Prevention Association, "Match Flame Test," Fire Tests No. 701, Sec. 60 (1966) which determines whether a fabric specimen held in vertical position can be ignited by a match, or by the more sophisticated Fire Resistance of Textile Fabrics Test (American Association of Textile Chemists and Colorists, Test Method 34-1969, "Fire Resistance of Textile Fabrics") which measures the char length produced by a Bunsen flame. As mentioned earlier, fabrics may also be produced in accordance with this invention which, although supporting combustion, show reduced rates of flammability. The International Nonwovens and Disposables Association has decreed that the conventional Flammability of Clothing Textile Test (American Association of Textile Chemists and Colorists, Test Method 33-1962, "Flammability of Clothing Textiles," or Disposable Association Recommended Test (DART) 50.0-71, "Flammability"), will be used to measure the degree of flammability of such nonwoven disposable soft goods. This test measures the time of burn over a length of 6 inches of a specimen of fabric held at a 45° angle. The nonwovens industry has at present followed the lead from the textile industry in adapting a minimum burn-time of 3.5 seconds as the requirement for all disposable soft goods to be used in clothing applications. There have been recent discussions, however, between the nonwoven industry and governmental agencies suggesting that the flammability limits may be changed in the future to a minimum burn time of eight seconds on all "paper-like" nonwovens used as clothing.

The following examples are presented to illustrate and clarify the invention, and to demonstrate the unexpected advantages obtained by its practice in the manufacture of disposable nonwoven fabrics.

EXAMPLE 1

A commercial cotton scrim of 13 by 10 thread count was attached to a tack frame in such a manner as to loosely stretch the material in all directions. With the scrim supported by a glass plate, fire-retardant, "surfactant-free" adhesive (an aqueous suspension of polyvinyl acetate, diluted with water to 40% by weight solids, containing polyvinyl alcohol as suspension stabilizer, and the fire-retardants tris(2,3-dibromopropyl) phosphate and diphenylcresyl phosphate, 25 and 28%, respectively (based on the weight of polymer residue) was applied and evenly distributed by means of a rubber roller (approximately 100% wet pickup. The frame with scrim were then placed over a sheet of cellulosic tissue, dry weight 2.8 g/sq. ft. A second sheet of the same tissue was then placed over the top of the scrim and the sheets pressed with the roller. The scrim-reinforced ("SRM") nonwoven fabric, thus produced, was removed from the frame, dried on a Williams plate dryer at 203°F and trimmed. Weight of adhesive applied, on basis of total fabric, was approximately 20%.

The above-prepared SRM fabric was treated by immersion in an aqueous bath containing 5% ammonium sulfamate and 2.5% fluorochemical repellent (a polymeric latex* derived from the monomer

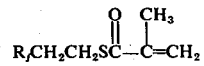

where $R_f$ is perfluoroalkyl of 7 to 11 carbon atoms, according to U.S. Pat. No. 3,544,663), and then passed through pressure rolls of an Atlas laboratory padder so as to give approximately 90% wet pick-up of solution. The sheet was then dried on a Williams plate dryer at 200°F, and cured at 250° F for 2½ minutes in a forced air oven. The treated nonwoven fabric resisted water penetration for over one hour in the Mason Jar Test and was found to be self-extinguishing by the Match Flame Test. (The Mason Jar Test is the Disposables Association Recommended Test (DART) 80.9-70, for water repellency evaluation. This test measures the time of penetration of a 0.9% saline solution, under pressure of a 4½ inch head, through a specimen of nonwoven fabric held in the mouth of a standard Mason Jar by screw-ring and gasket, and supported on a flat glass plate.)

* A 20% solids dispersion made by mixing, on a 50/50 solids basis, an emulsion copolymer of 80% $C_8F_{19}C_2H_4SC(O)C(CH_3)=CH_2$ and 20% stearyl methacrylate, and an emulsion copolymer of 71% butyl methacrylate, 24% of 3,5,5-trimethylhexyl methacrylate and 5% N-methylolacrylamide.

Examples 2–5 deal with the application of a variety of water repellent agents and fire retardants as the second step of the treatment of an SRM fabric as produced in Example 1, with fire-retardant adhesive. The procedure used in all cases is the same as described above.

EXAMPLE 2

A sample of SRM nonwoven fabric prepared as in the previous example was treated in an aqueous bath containing 2% of fluorochemical repellent, 28% solids ("Scotchgard FC-208, " 3M Co., a polymeric latex derived from the monomer $C_8F_{17}SO_2N(C_3H_7)C_2H_4OOCC(CH_3)=CH_2$, according to U.S. Pat. No. 3,068,187); 2% of an emulsion of a reactive nitrogenous extender resin ("Aerotex Repellent 96, " American Cyanamid Co.), and 4% of ammonium bromide to give 90% wet pickup of solution, and then dried. The treated fabric resisted water penetration for over one hour by the Mason Jar Test, and was self-extinguishing by the Match Flame Test.

EXAMPLE 3

A sample of the SRM nonwoven fabric as described in Example 1 was treated in an aqueous bath containing 0.7% of the fluorochemical repellent described in Example 1; 0.7% of an emulsion of a hydrophobic extender resin ("Norane 18," product of Sun Chemical Co.); and 4% of a complex phosphate compound ("Graftex 281," GAF Corp.), to give 90% wet pickup, and then dried. The treated fabric resisted water penetration for over 1 hour in the Mason Jar Test and was shown to be self-extinguishing by the Match Flame Test.

EXAMPLE 4

Another sample of the SRM fabric treated in the previous examples was immersed in an aqueous bath containing 2.4% fluorochemical repellent (30% solids) consisting of a chromium coordination complex of perfluoroalkyl carboxylic acids, according to U.S. Pat. No. 3,351,643; and 5% ammonium sulfamate, to give approximately 90% wet pickup, and then dried. The treated nonwoven fabric resisted water penetration for 15 minutes in the Mason Jar Test, and was found to be self-extinguishing by the Match Flame Test.

EXAMPLE 5

An SRM nonwoven fabric was prepared as described in Example 1 except that the weight of the surfactant-free adhesive composition was 25% based on the weight of dry fabric. An aqueous bath containing 1.5% of the fluorochemical repellent of Example 1 was padded onto the fabric to give a 90% wet pickup and the fabric was dried. It withstood water penetration for over one hour by the Mason Jar Test, and gave a burn time of 11 seconds on the 45° Flammability Test.

The following two examples demonstrate the advantages of the present two-bath fire retardant/repellent treatments when applied to a mixed-fiber, wet-laid nonwoven.

EXAMPLE 6

A commercially-manufactured, wet-laid, nonwoven sheet comprised of nylon, rayon and cellulose fibers was saturated with an aqueous bath containing 37.5% of a surfactant-stabilized polyvinyl chloride emulsion binder; 4% of the fluorochemical repellent of Example 1; 8% of "Norane 18" emulsion of a hydrophobic extender resin; and 12% of "Graftex 218" complex phosphate fire retardant compound, to give a 140% wet pickup. The sheet was then dried on the Williams plate dryer at 195° F and cured at 250°F for 2 ½ minutes in a forced-air oven. The nonwoven sheet, thus produced, was shown to be self-extinguishing by the Match Flame Test, but showed immediate penetration by water in the Mason Jar Test.

EXAMPLE 7

A sheet of the wet-laid nonwoven described in the previous example was saturated with a 60% solution of the fire-retardant binder resin of Example 1 to give approximately 140% wet pickup, and dried and cured as in the preceeding example. Using the techniques of Example 1, the fabric was contacted with an aqueous bath containing 2% of the fluorochemical repellent described in Example 1; 6% of the "Norane 18" emulsion of hydrophobic extender resin; 12% of ammonium sulfamate, and 2% isobutyl alcohol, to give 43% wet pickup, and then dried. The resulting nonwoven resisted penetration of water for 20 minutes in the Mason Jar Test and was shown to be self-extinguishing by the Match Flame Test.

The following example illustrates the difficulty of achieving acceptable and economical repellency and flame retardancy for nonwoven fabric produced when conventional adhesives are employed.

EXAMPLE 8

A commerical SRM nonwoven fabric consisting of two layers of cellulose tissues combined with a cellulosic scrim, produced without a fire-retardant adhesive, was saturated by passing it below the surface of an aqueous bath containing 1% of fluorochemical repellent (20% solids) as described in Example 1, and then through the pressure rolls of an Atlas laboratory padder so as to give approximately 115% wet pick-up. The sheet was then dried on a Williams plate dryer at 90°C, and cured at 120°C for 2½ minutes in a forced-air oven. The treated nonwoven thus produced showed no water penetration after 60 minutes in the Mason Jar Test, but was highly flammable when tested by the Match Flame Test.

Another sheet of the original nonwoven fabric was treated in an aqueous bath containing 20% of ammonium sulfamate (sufficient as previously determined to produce complete nonflammability), and 10% of the fluorochemical. The resulting treated fabric was found to be self-extinguishing by the Match Flame Test, but despite the high level of expensive fluorochemical, withstood water penetration in the Mason Jar Test for only 3 minutes.

The following examples, 9–13, demonstrate the preparation and use of a variety of fire-retardant, surfactant-free adhesives for nonwoven fabrics in accordance with the process of this invention.

EXAMPLE 9

A surfactant-free polyvinyl acetate polymer dispersion was prepared as follows. A polyvinyl alcohol dispersion "stabilizer" was prepared by adding 13.9 grams "Elvanol 52-22" and 4.6 grams of "Elvanol 51-05" (polyvinyl alcohols, 4% aqueous solutions of which have viscosities at 20°C of 21–25 cp and 4–6 cp, respectively, determined by the Hoeppler falling ball method; products of DuPont Co.) to 218.7 g. of water with stirring and warming. One third of this solution was charged to a stirred polymerization flask. With stirring, a 194.6-grams "heel" of a previously prepared surfactant-free polyvinyl acetate polymer dispersion, 43.8 grams of vinyl acetate monomer, 64.6 grams of water, and 0.9 gram of sodium bicarbonate were added. The flask was purged with nitrogen, 4.8 grams of 4% aqueous hydrogen peroxide added, and the reaction mix heated to 78°–80°C. Over the next four-hour period the remaining polyvinyl alcohol solution and 400.1 grams of additional vinyl acetate monomer were slowly added, followed by the addition of 54 grams of 7.4% hydrogen peroxide solution. After the reaction exotherm had dissipated, the temperature of the reaction mix was raised to 90°C, held there for 1 hour, then cooled. The resulting polymer dispersion contained 50% solids.

One hundred grams of the "surfactant-free" polyvinylacetate dispersion polymer prepared above was placed into a Waring Blender, and while mixing at slow speed, 25 grams of tri(dibromopropyl) phosphate and 25 grams of diphenyl cresyl phosphate were added. Mixing was continued for 2 minutes. The resulting adhesive was used to prepare a SRM nonwoven fabric using the techniques described in Example 1.

The nonwoven fabric was then treated with an aqueous bath containing 0.5% of the fluorochemical repellent of Example 1; 1.25% of "Aerotex 96" extender resin, and 6% of ammonium sulfamate, to obtain a wet pickup of about 90%. The dried, treated nonwoven fabric resisted water penetration for over 1 hour in the Mason Jar Test, and was found to be self extinguishing by the Match Flame Test.

EXAMPLE 10

An aqueous, surfactant-free, polyvinyl acetate polymer dispersion prepared as in Example 9 was mixed in a Waring Blender for 2 minutes with 35 grams tris(dichloropropyl) phosphate and 35 grams water. The resulting dispersion, containing approximately 50% solids, was used as an adhesive to prepare an SRM fabric as described in Example 1. The resulting SRM fabric, containing 30% adhesive solids on a dry weight basis, was then padded with an aqueous bath containing 2% of the fluorochemical repellent of Example 1 and 1% of ammonium sulfamate, and dried. The treated fabric withstood water penetration in excess of 1 hour in the Mason Jar Test, and gave a burn time of 8 seconds in the 45° Flammability Test.

EXAMPLE 11

One hundred grams of a commercially available, surfactant free, lower acrylate polymer aqueous dispersion ("National Starch 1856-63") was mixed for 2 minutes at slow speed in a Waring Blender with 25 grams of tris(dibromopropyl) phosphate, 28 grams of diphenyl cresyl phosphate, 10 grams of polyacrylic acid thickener ("Acrysol GS," a product of Rohm and Haas Co.), and 17 grams of water. The resulting dispersion, containing 57% solids, was used as the adhesive in preparing an SRM nonwoven fabric using the techniques described in Example 1. The fabric was then treated with an aqueous bath containing 2% of the fluorochemical repellent of Example 1, 2.5% of "Aerotex 96" extender, and 6% of ammonium sulfamate, and dried. The treated nonwoven fabric resisted water penetration over 1 hour in the Mason Jar Test, and was found to be self extinguishing by both the Match Flame and 45° Flammability Test.

EXAMPLE 12

One hundred twenty grams of a commercially available, surfactant-free, aqueous dispersion acrylate polymer binder composition ("Nacrylic 4401," National Starch Co.) was mixed for 2 minutes at show speed in a Waring blender while adding 25 grams of tris (dibromopropyl) phosphate and 25 grams of diphenyl cresyl phosphate. The resulting dispersion, containing 58.5% solids, was diluted to 50% solids with water and used as the adhesive in the preparation of an SRM fabric as described in Example 1. The resulting nonwoven fabric, containing 28% adhesive on a dry weight basis, was padded with an aqueous bath containing 2.5% of the fluorochemical repellent of Example 1 and 2% of a ammonium sulfamate to give an 88% wet pickup, and dried. The treated fabric resisted water penetration for over 1 hour in the Mason jar Test, and gave a burn of 25 seconds in the 45° Flammability Test.

EXAMPLE 13

One hundred twenty grams of the polymer dispersion used in Example 12 was mixed in a Waring Blender with a premix of 20 grams of tris($\beta$-chloroethyl) phosphate, 10 grams tricresyl phosphate and 5 grams decabromodiphenyl oxide. The resulting dispersion, solids content 55%, was diluted with water to 40% solids and used as the adhesive in preparing an SRM fabric according to the technique of Example 1. This fabric was padded with an aqueous bath containing 2.5% of the fluorochemical repellent of the preceding examples and 3% of a commercially available mixture of fire-retardant complex phosphate salts ("Gaftex 281," GAF Corp.) to give about 85% wet pickup, and dried. The treated fabric resisted water penetration in excess of 1 hour in the Mason Jar Test, and gave a burn time of 12 seconds in the 45° Flammability Test.

The examples that are next presented demonstrate even more dramatically that the claimed two-step process provides economical water repellency and fire retardancy in nonwovens, and is compared to the poor results obtained by simultaneous application of the agents, that is, as a one-step treatment.

EXAMPLE 14

In an attempt to carry out Example No. 1 as a "one-step" process the following formulation (for 50% wet pick-up) was made up as the adhesive:

65 gms. of the adhesive suspension (62% solids)
4.5 gms. fluorochemical repellent
9.0 gms. ammonium sulfamate dissolved in
21.5 gms. water The resulting formulation immediately coagulated and was of no value as an adhesive.

EXAMPLE 15

In an attempt to carry out Part 2 of Example 9 as a "one-step" process, the following adhesive was formulated (for 50% wet pick-up):

50 gms. vinyl acetate polymer latex (50% solids)
12.5 gms. tri(dibromopropyl) phosphate
12.5 gms. diphenyl cresyl phosphate
2.7 gms. fluorochemical repellent
1.0 gm. "Aerotex 96" repellent
10.0 gms. ammonium sulfamate in 10gms. water.

The resulting latex formulation immediately coagulated and was of no value.

EXAMPLE 16

In an attempt to make a one-step version of Example 5 the following adhesive formulation was made up:

65 gms. adhesive suspension (62% solids)
2.25 gms. fluorochemical repellent
32.75 gms. of water An SRM fabric was prepared using the same materials of construction and the same techniques as described in Example 14 above. Pick-up of the adhesive solids was 29% (estimated 72% wet pick-up) on the weight of the dry fabric. Drying was done on a Williams plate dryer and curing in a forced-air oven at 120°C for 3 minutes. The resulting fabric was immediately penetrated by water in the Mason Jar Test, and showed an 8-second burn time on the 45° Flammability Test. Water repellency performance from this one-step process was therefore much inferior to that obtained by the two-step procedure of Example 5 in which the sheet resisted water penetration for over 60 minutes.

EXAMPLE 17

In a second attempt to make a one-step version of Example 5, the following adhesive was formulated, greatly increasing the amount of expensive fluorochemical repellent:

65 gms. of the adhesive suspension (62% solids)
10 gms. fluorochemical repellent
25 gms. of water In the same manner as in Example 16 an SRM nonwoven sheet was prepared. Pick-up of dry adhesive was 32% (estimated 80% wet pick-up). Again there was immediate penetration by water in the Mason Jar Test thus emphasizing the poor performance obtained with a one-step process. Burn time on the 45° flammability test was 7 seconds.

EXAMPLE 18

In another possible one-stop process (one expected to give maximum saturation of the outer tissues of the SRM fabric) techniques similar to those used with wet-laid nonwovens were employed. Two sheets of the cellulosic tissue sandwiched dry over a cellulosic scrim (same materials of construction as previously used) were dipped below the surface of a bath comprised of:

26.5 gms. of the adhesive suspension of Example 1 (62% solids)
0.9 gms. fluorochemical repellent of Example 1
72.5 gms. water The sandwich was passed through the rolls of a laboratory Atlas padder. The wet pick-up was approx. 150% (thus giving approximately the same pick-up of binder and repellent as used in Example 5). The resulting sheet was dried on a Williams plate dryer and then further dried in a forced-air oven at 120° C for 3 minutes. The resulting sheet showed immediate penetration by water in the Mason Jar Test showing again the poor performance from a one-step process. Burn time on the 45° flammability test was 6 seconds.

EXAMPLE 19

In additional experiments using the method of Example 18, in which the amount of the fire-retardant adhesive binder was increased by 20% and the amount of fluorochemical repellent by a multiple of 5.5, the maximum time that the fabric withstood water penetration by the Mason Jar Test was only 3 to 4 minutes, a very to showing. Maximum burn time was 7 seconds.

I claim:

1. A process for preparing an oil and water-repellent, fire retardant, nonwoven fabric which comprises the steps of: (A) providing a dry nonwoven fabric of fibers bound together by about 5 to 50%, based on dry weight of the nonwoven fabric, of surfactant-free adhesive solid selected from the class consisting of vinyl acetate and alkyl acrylate aqueous dispersion polymers, containing in admixture therewith from about 25 to 110%, based on the weight of the polymer, of a flame retardant agent selected from the group consisting of halogen, phosphorus and halogen and phosphorus containing flame retardants; (B) treating the fabric with an aqueous bath containing in admixture a fluorochemical oil and water-repellent composition in an amount sufficient to deposit on the fabric from about 0.05 to 0.8% solids by weight thereof, based on the dry fabric weight, and drying the fabric.

2. A process according to claim 1 wherein the amount of adhesive used in step A is from about 20 to 30%.

3. A process according to claim 1 wherein the amount of flame retardant additive agent is from about 50 to 100% based on the weight of polymer.

4. A process according to claim 1 wherein the flame retardant additive agent is selected from the group consisting of tricresyl phosphate, diphenyl cresyl phosphate, tributyl phosphate, trioctyl phosphate, tris (2-ethylhexyl) phosphate, tris(chloroethyl) phosphate, tris(dichloropropyl) phosphate, tris(dibromopropyl) phosphate, and chlorinated paraffins.

5. A process according to claim 1 wherein the aqueous bath of step B contains a water-soluble fire-retardant salt in an amount sufficient to deposit up to about 6% of salt based on weight of dry fabric.

6. A process according to claim 5 wherein the fire-retardant salt is selected from the group consisting of ammonium sulfate, ammonium sulfamate, ammonium bromide, mono-and diammonium phosphates, borax, and boric acid salts.

* * * * *